United States Patent [19]

Rainer et al.

[11] 4,123,592

[45] Oct. 31, 1978

[54] PROCESS FOR INCORPORATING FLAVORANT INTO CELLULOSIC SUBSTRATES AND PRODUCTS PRODUCED THEREBY

[75] Inventors: Norman B. Rainer; Peter A. Wilson, both of Richmond, Va.

[73] Assignee: Philip Morris Incorporated, New York, N.Y.

[21] Appl. No.: 674,613

[22] Filed: Apr. 7, 1976

[51] Int. Cl.[2] ..... D21H 1/40; D21H 5/22

[52] U.S. Cl. ..... 428/532; 131/2; 131/17 R; 131/140 R; 131/144; 427/397; 427/394; 427/395; 427/396; 427/439; 427/440; 428/537

[58] Field of Search ..... 131/2, 17 R, 140 R, 131/144; 427/394, 393, 395, 396, 397, 439, 440; 428/532, 537; 426/132, 650, 651

[56] References Cited

U.S. PATENT DOCUMENTS

| | | | |
|---|---|---|---|
| 2,921,853 | 1/1960 | Card et al. | 426/651 X |
| 2,933,431 | 4/1960 | Sperouleas | 424/28 X |
| 3,619,280 | 11/1971 | Scheuer | 15/104.93 X |
| 3,818,533 | 6/1974 | Scheuer | 15/104.93 X |

*Primary Examiner*—Michael R. Lusignan

*Attorney, Agent, or Firm*—Watson, Leavenworth, Kelton & Taggart

[57] ABSTRACT

Stable cellulosic products containing releasable flavorant are described. These products are produced by impregnating a dry cellulosic substrate with an essentially anhydrous ammonia solution of a volatile flavorant and then subjecting the impregnated substrate to conditions of temperature and pressure sufficient to effect evaporation of essentially all of the impregnated solvent.

11 Claims, No Drawings

PROCESS FOR INCORPORATING FLAVORANT INTO CELLULOSIC SUBSTRATES AND PRODUCTS PRODUCED THEREBY

INTRODUCTION TO THE INVENTION

It is an object of this invention to produce a cellulosic substrate containing volatile flavorant in stable form.

It is a further object of this invention to produce stable cellulose products containing volatile flavorant which can be released, when desired, for maximum flavor benefit.

It is a particular object of the present invention to provide improved smoking constituents and articles composed at least in part of a flavorant-impregnated cellulosic substrate which will enhance smoking enjoyment.

These, and other objects and advantages as are described in the specification, are achieved through the present invention.

DESCRIPTION OF THE INVENTION

This invention relates to the incorporation of flavorant within cellulosic substrates. The products of this invention contain volatile flavorant—preferably odorant—in an inert and virtually undetectable form. When desired, however, it may be released through contact with heat, liquid moisture, or a combination thereof.

The substrates suitable for use in accordance with this invention are ones which are cellulosic in composition. These substrates include tobacco, wood, paper, regenerated cellulose film or fiber, cotton and cardboard. Various modified cellulosic materials—particularly partially thermally degraded or pyrolyzed cellulose such as that described in British Pat. No. 1,113,979 relating to synthetic or substitute tobacco smoking compositions—may also be utilized.

These substrates must be composed—at least in part—of the carbohydrate polymer characteristic of cellulose. It is not necessary, however, that the glucose residue units of the polymer remain completely unaltered. Partial alteration or substitution of side chains and/or of some of the glucose units is permissible. Similarly, cellulosic substrate may contain or be admixed with other components. It is ordinarily preferred, however, that the substrate to be treated contain at least about 20% of cellulosic material by total weight.

It is also necessary that the substrate be dry. This does not, however, mean that no water may be present. Cellulose ordinarily contains about 8—15% bound water in its "dry" state and such an amount does not destroy the results of this invention. Free or excess liquid water, however, greatly diminishes the effectiveness of flavorant incorporation and retention. Accordingly, "dry" as utilized herein excludes such liquid water and indicates a substrate containing essentially no water which is not bound in hydrated or similar form.

Flavorants useful for incorporation within these substrates are the volatile solid and, preferably, liquid organic compounds and substances known for desirable flavor in the art. These flavorants are primarily odorants which act through the olfactory as opposed to taste senses. They include, by way of example, benzaldehyde, methyl salicylate, cinnamaldehyde, acetophenone, menthol, anisole, amyl acetate, eucalyptol, carvone, anethole and extracts of fruit such as lime, orange, cherry and the like.

The most preferred flavorants are those having a boiling point within the range of from about 100° to 260° C. and particularly ones having a vapor pressure between 1 and 10 mm of Hg at a temperature of 60° C. These compounds exhibit excellent retention within the substrate until eventually released by the action of moisture and/or heat.

The products of this invention are produced by impregnating the cellulosic substrate with volatile flavorant dissolved in essentially anhydrous, liquid ammonia. In order to incorporate the desired amount of flavorant within the substrate, a solution containing from about 1 to 30%, preferably from about 10 to 20%, by weight of flavorant is desired.

In performing this impregnation, it is necessary that the flavorant be essentially completely solubilized in the solution. While this is readily accomplished with most of the present flavorants, certain compounds—for example menthol—have a low solubility in pure liquid ammonia. In such instances, it is desirable to include in the solution a co-solvent for the flavorant. These co-solvents, which are desirably present in from about 1 to 30% by weight of solution, are normally polar liquids which are miscible with the ammonia and dissolve the flavorant. They are also desirably volatile, ordinarily having a boiling point below 100° C., preferably below 70° C. More preferably, such co-solvents are also miscible with water. Suitable co-solvents to be employed with the liquid ammonia include the lower molecular weight alcohols such as methanol and other polar solvents such as tetrahydrofuran.

As indicated above, the presence of liquid water during impregnation may adversely affect the results of this invention. It is therefore preferred that the solution of flavorant be anhydrous. Some water—up to about 5% preferably less than 2%—may be present, however, before the degree of interference with the mechanism of this invention becomes undue.

Impregnation of the cellulosic substrate with the solution of flavorant may be performed by any convenient means. Preferably, and to facilitate maintenance of the ammonia in liquid form, the impregnation is conducted at −33° C. or below, but ordinarily above about −70° C. In this temperature range, the ammonia is liquid at atmospheric pressure. Alternatively, however, increased pressure may be utilized at correspondingly higher temperatures. The only criticality for these temperatures and pressures is that the ammonia and any other solvent in the solution remain liquid.

The impregnation of flavorant into the substrate occurs virtually instantaneously upon contact. In order to insure homogeneous and/or complete impregnation, however, contact of at least 30 seconds, preferably from 1 to 10 minutes, is desired.

The actual step of impregnation may also be performed in many different ways. The solution of flavorant may, for example, simply be sprayed onto the cellulosic substrate. Preferably, however, the substrate is immersed in a bath of the flavorant solution. This technique facilitates high volume production of the flavor-containing products and insures complete and homogeneous impregnation. By whatever means applied, best results are obtained where the substrate being impregnated is thoroughly saturated with the solution of flavorant.

Once the substrate has been impregnated with the flavorant solution, the ammonia is removed. Again, removal may be performed by any means apparent to those of ordinary skill in the art. Where the substrate is immersed in a bath or impregnated by other means which utilize a substantial excess of flavorant solution, it is desirable first to remove the impregnated substrate from the excess solution. In the case of spraying or the like, this step is not necessary.

Removal of the ammonia which has been impregnated into the substrate is accomplished by subjecting the impregnated substrate to a condition of temperature and pressure sufficient to effect its evaporation. Depending upon the means utilized to maintain the ammonia in liquid form during impregnation, this condition may be obtained by raising the temperature of the substrate, reducing the pressure on the substrate, or both, to above its temperature/pressure point of evaporation. Essentially all of the ammonia must be removed, preferably at between −33° C. and +80° C. with a pressure of from 1 to 760 mm of Hg.

Where an ammonia co-solvent is utilized during impregnation, removal of this second material is optional but preferred. If sufficiently volatile, the co-solvent will be at least partially evaporated under the conditions required for the ammonia. Still higher temperatures and/or lower pressures may, however, be employed to removal all the original solvent for the flavorant.

In a preferred embodiment, the substrate from which essentially all the ammonia has been removed is stored under at least ambient conditions before use. This further treatment of maintaining the substrate at atmospheric pressure and a temperature above 10° C. effects removal of any residual free volatiles. Temperatures of from about 10° C. to 100° C. are preferred for this step which strips the substrate of unnecessary and/or deleterious volatiles without removing the desired, incorporated flavorant. This further treatment may continue for whatever period of time—ordinarily at least several days or weeks—as is desired.

This storage or stripping step eliminates ammonia traces and any co-solvent not earlier evaporated. Some flavorant not intimately bound by the cellulose is also usually removed. As a result, the substrate appears to be essentially free of the impregnation materials, until activated to release the portion of flavorant held in stable form.

Significantly, this straightforward impregnation and evaporative sequence effects incorporation of a desirable amount of flavorant within the cellulosic substrate even though the flavorant itself is volatile. Despite the fact that the conditions of evaporation of solvent may be such as would be expected also to remove flavorant, desirable amounts of from about 0.3 to 6%, preferably from about 1 to 4%, of the flavorant are at least initially retained within the present products and from about 0.2 up to at least 2.0% are held in stable, essentially inert form until the substrate is activated by liquid water and/or heat.

It is believed that the means by which this retention is obtained is entrapment of the flavorant molecules within the cellulosic constituent of the substrates. Thus it is known that liquid ammonia is a swelling or expanding agent for the cellulose polymer structure. It is therefore believed that the cellulose of the present substrates is expanded during impregnation to an extent sufficient to allow migration of the present flavorant molecules into their enlarged structures. Thereafter, upon removal of the liquid ammonia swelling agent, the cellulose structure contracts to its original size, physically binding or encapsulating the flavorant in an essentially inactive form.

Upon subsequent exposure of the products to liquid water—also a known swelling agent—it is theorized that the mechanism for eventual release of the present flavorant is the reverse of the foregoing sequence. Thus upon re-swelling or re-expansion of the cellulose containing entrapped flavorant, the flavorant is released to provide the desired flavor sensation. Although heat is not normally considered a swelling agent, it also releases flavorant from the present products. Here it appears to be the destruction of the cellulosic structure itself, which results in the release of these volatile molecules. In addition, heat in both circumstances accelerates volatilization of released flavorant, thus accentuating the flavor sensation.

Although it is believed that the foregoing accurately explains the manner of incorporation and release of the present flavorants, this theory is offered by way of explanation only. It is therefore not intended to be limitative of the scope of this invention.

The utilities of the products of the present invention are as many and varied as are the forms of the cellulose substrate to which this invention may be applied. Thus, for example, one embodiment of the present invention includes flavor-impregnated paper towels. These towels containing, for example, a perfume odorant, are virtually indistinguishable in appearance from any other. Upon contact with water—as where utilized to dry an individual's hands or face—the flavorant is released to yield a refreshing and desirable aroma note.

In another embodiment, the present cellulosic products are utilized in a smoking article. Lower grade tobaccos or substitutes such as partially pyrolyzed cellulose may be impregnated with the present flavorant and utilized as the smoking material of a cigarette or like article. In this use, the flavorant is released during smoking and enters into the smoke stream for inhalation and sensing.

Another application of the present invention and smoking article is in paper-impregnated substrates utilized as part, or all, of the wrapper of the cigarette or the like. Here, it is most preferred that the impregnated paper be utilized as the tipping portion of the cigarette wrapper. The tipping portion is that which surrounds the mouthpiece of a cigarette. Where utilized as the tipping paper, impregnated paper substrate may be moistened, either incident to use or intentionally by the smoker, for the release of flavorant. Because the flavorant is then released from a position close to the nose of the smoker, it is relatively undiluted and provides an enhanced flavor sensation.

This invention is further illustrated by the following examples in which all percentages are on the basis of weight unless otherwise indicated.

EXAMPLE 1

A three-meter roll of 25 mm width cigarette tipping paper was immersed for two minutes in liquid ammonia solution maintained at −34° C. under atmospheric pressure. The solution contained dissolved benzaldehyde in an amount of 5% by total weight. The paper was removed by unwinding from the roll which remained submerged in the solution. As the paper was removed, it was placed in a stream of 75° C. air. After contact with the paper, the air and volatilized ammonia vapors were directed into a well ventilated hood. The paper was held in the flow of air for about 1 minute to render it essentially ammonia-free.

The paper was then heated in an air circulating oven at 90° C. until the odor of benzaldehyde could no longer be detected. Thereafter, the paper was exposed to ambient room air (20° C., 65% relative humidity) for a period of about one year. At the end of this time, the paper was analyzed and found to contain 0.4% benzaldehyde. No odor of benzaldehyde could be detected. When slightly moistened with liquid water, however, a strong odor of benzaldehyde was instantly produced.

EXAMPLE 2

The process of Example 1 was utilized to incorporate methyl salicylate in the cigarette tipping paper. After several months of exposure to air at 20° C. and 65% relative humidity, the paper still retained about 0.8% methyl salicylate.

The treated paper was utilized for the production of cigarettes. By moistening the treated tipping paper during smoking, a very satisfactory odor of methyl salicylate was produced.

EXAMPLE 3

A thin flax paper of the type utilized for wrapping tobacco to fabricate cigarettes was impregnated by passing the paper through a bath. In this case, the impregnation solution of liquid ammonia contained 5% of methanol as a co-solvent for the 5% by weight of menthol. After a residence time of 30 seconds for the paper in the solution bath, the ammonia and methanol were rapidly removed by passage of the paper through a 1 meter tunnel having a 60° C. flow of air countercurrent to the paper.

The resultant paper contained 2.1% menthol. It was utilized in the fabrication of cigarettes which exhibited essentially no odor of menthol. Upon smoking, however, menthol was released. It was particularly noticeable in the sidestream smoke—i.e. the smoke which emanates from the region of the burning coal during intervals between puffs.

EXAMPLE 4

A roll of commercial paper toweling was impregnated with flavorant by the process of Example 3. In this case, however, the impregnating solution of liquid ammonia contained 10% methanol and 5% by weight of orange extract.

The treated paper was essentially odor-free until utilized as a towel after washing. As the towel was used to dry the hands of the washer, a refreshing odor of orange was released.

EXAMPLE 5

Solvent-extracted burley tobacco stem material containing 35% cellulose was immersed in an anhydrous solution of 3% benzaldehyde in liquid ammonia. The solution was maintained at −40° C. under atmospheric pressure. After 6 minutes, the stem material was removed and the ammonia evaporated. The treated stem material was then exposed to ambient air until the odor of benzaldehyde was no longer detectable. The material was then analyzed and found to contain 1.8% benzaldehyde by total weight.

The treated stem material was then shredded and blended with four times its weight of regular (untreated) shredded tobacco. This blend was then rolled into cigarettes. In smoking comparison of these blended cigarettes with ones containing only regular shredded tobacco, the mildly flavored smoke of cigarettes containing treated stem material was evident.

We claim:

1. A method for producing stable, flavored cellulose products comprising impregnating a dry cellulosic substrate with an essentially anhydrous solution comprising liquid ammonia and a solute of volatile flavorant and then evaporating essentially all of the impregnated ammonia from said substrate such that from about 0.2% to 2.0% of the flavorant based on the dry weight of the cellulose is physically encapsulated within the cellulose structure and is not released therefrom until the cellulose is contacted with either heat or moisture.

2. The method of claim 1, wherein the solution contains from 1 to 30% by weight of flavorant.

3. The method of claim 2, wherein the solution additionally contains from about 1 to 30% by weight of a volatile polar liquid solvent for the flavorant.

4. The method of claim 1, wherein the substrate is impregnated at a temperature below about −33° C.

5. The method of claim 1, wherein evaporation of ammonia from the impregnated substrate is performed under conditions from −33° C. to +80° C. and from 1 to 760 mm. of Hg.

6. The method of claim 5, wherein the flavorant comprises an odor substance having a boiling point between about 100° and 260° C. at atmospheric pressure.

7. The method of claim 5, wherein the flavorant comprises an odor substance having a vapor pressure of between about 1 and 10 mm of Hg at 60° C.

8. The product produced by the process of claim 1.

9. The product of claim 8, wherein the substrate comprises paper.

10. The product of claim 8, wherein the substrate comprises particulate, partially pyrolyzed cellulose.

11. The product of claim 8, wherein the flavorant is selected from the group consisting of benzaldehyde, methyl salicylate, cinnamaldehyde, acetophenone, menthol, anisole, amyl acetate, eucalyptol, carvone, anethole, extract of fruit and admixtures thereof.

* * * * *